US006276648B1

(12) United States Patent
Katz et al.

(10) Patent No.: US 6,276,648 B1
(45) Date of Patent: Aug. 21, 2001

(54) SUPPORT ASSEMBLY FOR SUPPORTING A FIXTURE ON A WALL

(75) Inventors: Howard S. Katz, Riegelsville; William Tschirlig, Feasterville, both of PA (US)

(73) Assignee: Robern, Inc., Bristol, PA (US)

( * ) Notice: Subject to any disclaimer, the term of this patent is extended or adjusted under 35 U.S.C. 154(b) by 0 days.

(21) Appl. No.: 09/537,640

(22) Filed: Mar. 29, 2000

(51) Int. Cl.[7] ..... A47G 29/02
(52) U.S. Cl. ..... 248/235; 4/648; 248/250
(58) Field of Search ..... 248/235, 239, 248/250; 4/648

(56) References Cited

U.S. PATENT DOCUMENTS

| | | | | |
|---|---|---|---|---|
| 917,454 | | 4/1909 | Kelly | 4/640 |
| 1,254,170 | | 1/1918 | Taussig | 248/247 |
| 1,740,553 | | 12/1929 | Schmiedeknecht | 248/274.1 |
| 2,035,301 | | 3/1936 | Daugherty | 248/295.11 |
| 2,264,082 | | 11/1941 | Kintz | 248/125.1 |
| 2,283,794 | | 5/1942 | Crozier | 4/648 |
| 2,903,712 | | 9/1959 | Morris et al. | 4/640 |
| 3,012,250 | | 12/1961 | Morris et al. | 4/648 |
| 3,400,829 | * | 9/1968 | Youngston | 211/119.6 |
| 3,810,597 | | 5/1974 | Flegel et al. | 248/214 |
| 4,733,843 | * | 3/1988 | Bessinger | 248/250 |
| 5,064,158 | * | 11/1991 | Brazier et al. | 248/250 |

* cited by examiner

*Primary Examiner*—Ramon O. Ramirez
(74) *Attorney, Agent, or Firm*—Akin, Gump, Strauss, Haurer & Feld, L.L.P.

(57) ABSTRACT

A support assembly for supporting a fixture on a wall comprises first and second threaded rods for installation into the wall so that at least a portion of each rod extends outwardly from the wall by a first predetermined distance. The support assembly further includes first and second fixing members each having internal threads which compliment the threads on the threaded rods. An elongated rigid support member having first and second ends, first and second lateral sides and top and bottom surfaces is provided. The support member includes a first notch in the top surface at a second predetermined distance from the first end, the first notch being sized for receiving the first fixing member therein. A first bore extends from the first end toward the second end, the first bore being located a third predetermined distance from the top surface and intersecting the first notch, the first bore being sized for receiving the first threaded rod. A second notch extends into the bottom surface at a fourth predetermined distance from the first end, the second notch being sized for receiving the second fixing member therein. A second bore extends from the first end toward the second end, the second bore being located a fifth predetermined distance from the bottom surface and intersecting the second notch. The second bore is sized for receiving the second threaded rod.

9 Claims, 4 Drawing Sheets

SUPPORT ASSEMBLY FOR SUPPORTING A FIXTURE ON A WALL

BACKGROUND OF THE INVENTION

The present invention relates generally to fixtures, such as bathroom fixtures and the like, and, more particularly, to a support assembly for supporting a fixture on a wall.

Over the years, many different devices and methods have been developed for supporting fixtures, such as bathroom sinks, on a supporting wall. Some devices and methods are sufficient to provide all of the support needed for the fixture. In the case of other devices and methods, supplemental supports, such as legs, which extend downwardly from the outwardly extending edge of the fixture are required. Such supporting devices and methods are generally adequate for their intended purposes and for use in supporting prior art porcelain or other generally opaque fixtures.

More recently, some fixtures, particularly bathroom sinks, have evolved from the original porcelain to a much more decorative configuration. Many such fixtures, in fact, are comprised of one or more glass or other substantially transparent panels which support a glass, or metal bowl. Such glass or transparent panels are not well suited to any of the prior art supporting devices and methods which are not decorative in nature. Accordingly, a need exist for a more elegant and decorative solution which provides adequate support to a fixture while providing an acceptable decorative appearance.

BRIEF SUMMARY OF THE INVENTION

Briefly stated, the present invention comprises a support assembly for supporting a fixture on a wall. The support assembly comprises first and second threaded rods for installation into the wall so that at least a portion of each threaded rod extends outwardly from the wall by at least a first predetermined distance. First and second fixing members are provided, each fixing member having internal threads which compliment the threads on the threaded rods. An elongated generally rigid support member having first and second ends, first and second lateral sides, and top and bottom surfaces is provided. The support member includes a first notch in the top surface at a second predetermined distance from the first end, the first notch being sized for receiving the first fixing member therein. A first bore extends from the first end toward the second end of the support member, the first bore being located a third predetermined distance from the top surface and intersecting the first notch, the first bore being sized for receiving the first thread rod. A second notch is located in the bottom surface at a fourth predetermined distance from the first end, the second notch being sized for receiving the second fixing member therein. A second bore extends from the first end toward the second end, the second bore being located a fifth predetermined distance from the bottom surface and intersecting the second notch, the second bore being sized for receiving the second threaded rod. In use, the support member is installed with the first end in engagement with the wall and with the first and second rods extending into the first and second bores respectively. The first threaded rod is in threaded engagement with the first fixing member in the first notch and the second threaded rod is in threaded engagement with the second fixing member in the second notch. The first and second fixing members are rotatable within the first and second notches respectively to secure the support member to the wall and to adjust the support member to be level.

BRIEF DESCRIPTION OF THE SEVERAL VIEWS OF THE DRAWINGS

The foregoing summary, as well as the following detailed description of preferred embodiments of the invention will be better understood when read in conjunction with the appended drawings. For the purpose of illustrating the invention, there are shown in the drawings, embodiments which are presently preferred. It should be understood, however, that the present invention is not limited to the precise arrangements and instrumentality shown. In the drawings.

DETAILED DESCRIPTION OF THE INVENTION

Figure 1:
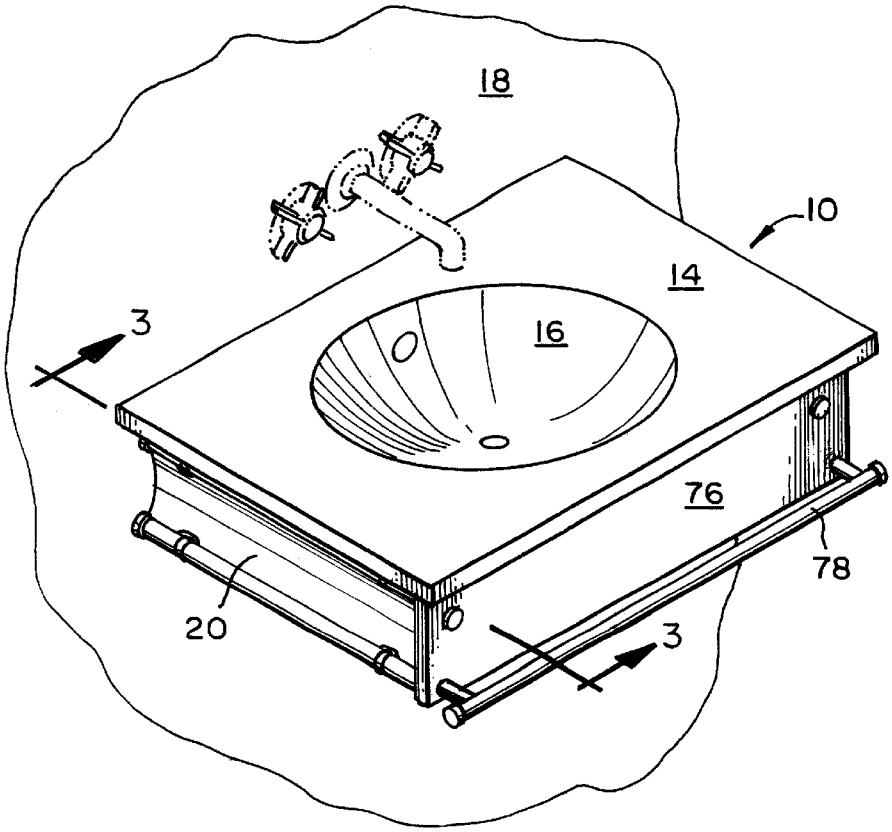
FIG. 1 is a perspective view of a fixture supported on a wall by a pair of support assemblies in accordance with a first preferred embodiment of the present invention.

Referring the drawings, wherein the same reference numerals are used for indicating the same components throughout the several figures, there is shown in FIGS. 1, 4, 5 and 6 a fixture which is supported on a wall by a pair of decorative support assemblies 10 in accordance with a first preferred embodiment of the present invention. For purposes of illustration, the support assemblies 10 are shown as supporting a typical bathroom sink or lavatory 12 of the type having a generally flat counter 14 and a downwardly extending bowl 16. Although, the bathroom sink 12 is illustrated as being generally opaque, it will be appreciated by those of ordinary skill in the art that the present invention can be employed for supporting a transparent or translucent bathroom sink or virtually any other similarly constructed fixture. Accordingly, the particular design or style of the bathroom sink 12 or other fixture should not be considered to be a limitation on the present invention.

As illustrated by the figures, the fixture or bathroom sink 12 is completely supported on the wall 18 by the two support assemblies 10, one on each lateral side of the bathroom sink 12. For purposes of brevity, only a single support assembly 10 (in this case the leftmost support assembly when viewing FIG. 1) will be described in detail with the understanding that the same description is equally applicable to the other support assembly.

Figure 2:
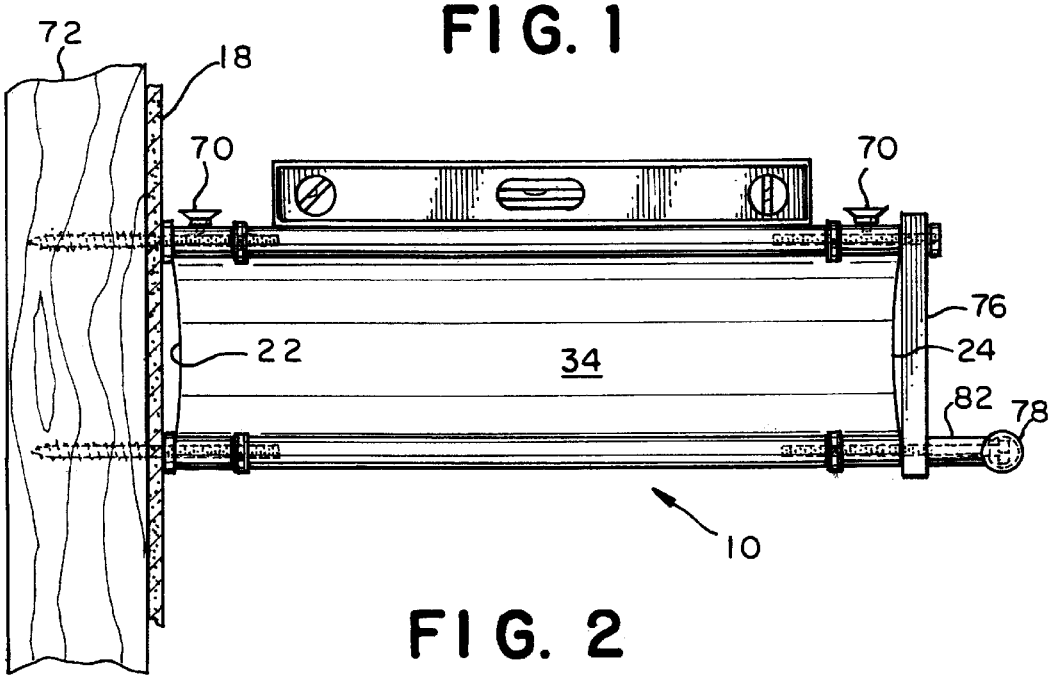
FIG. 2 is a side elevational view of a support assembly employed for supporting the fixture of FIG. 1.
Figure 3:
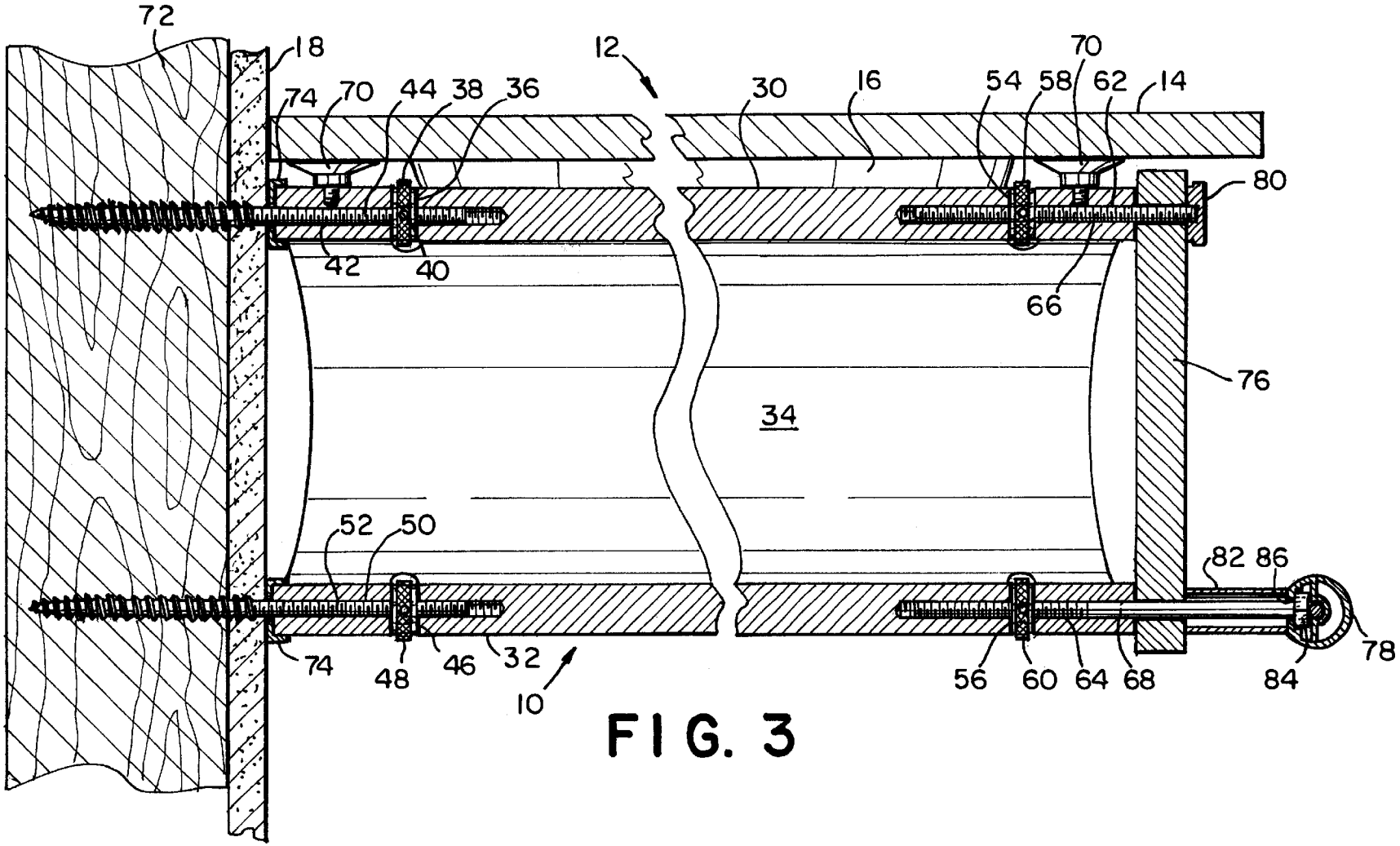
FIG. 3 is an enlarged sectional view of the support assembly of FIG. 2.
Figure 4:
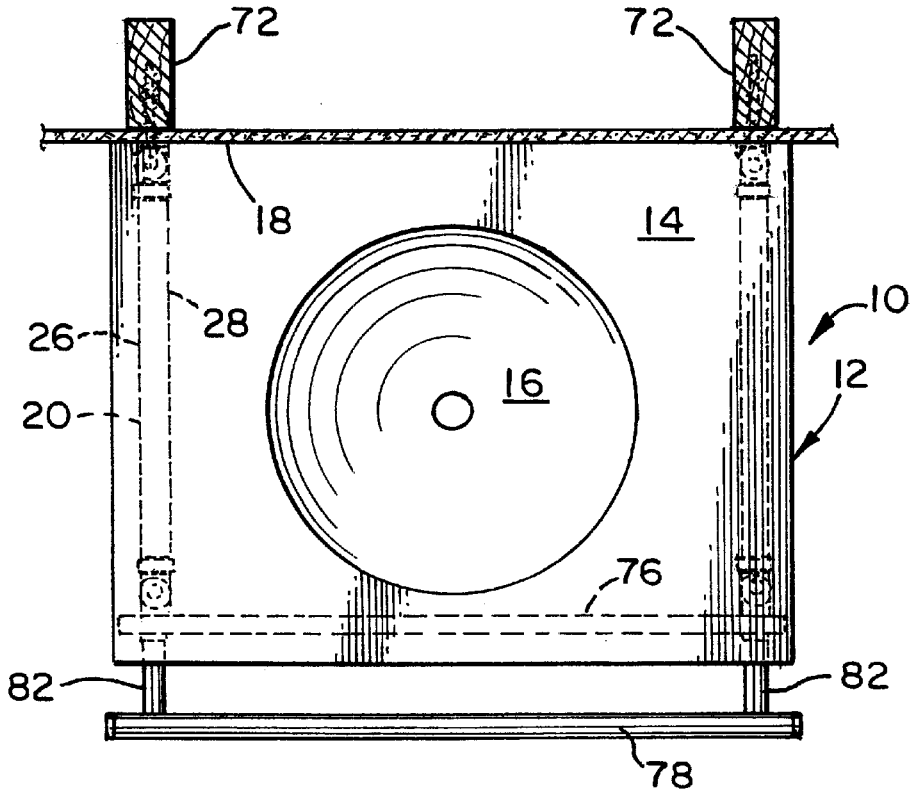
FIG. 4 is a top plan view of the fixture of FIG. 1 illustrating the location of the two support assemblies.
Figure 5:
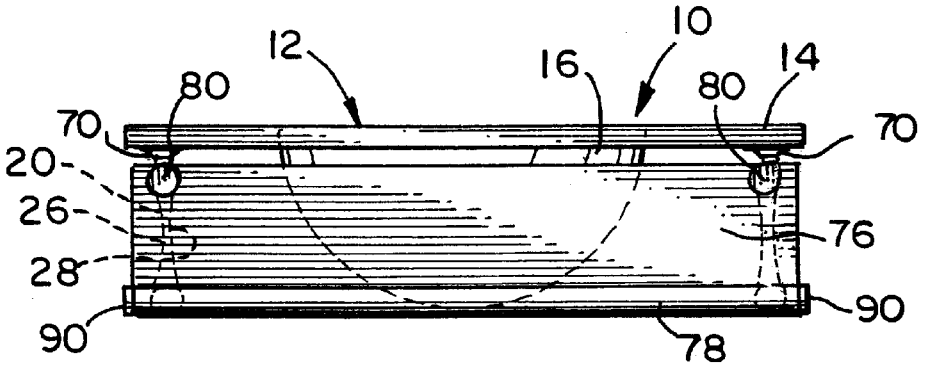
FIG. 5 is a front elevational view of the fixture of FIG. 1.
Figure 6:
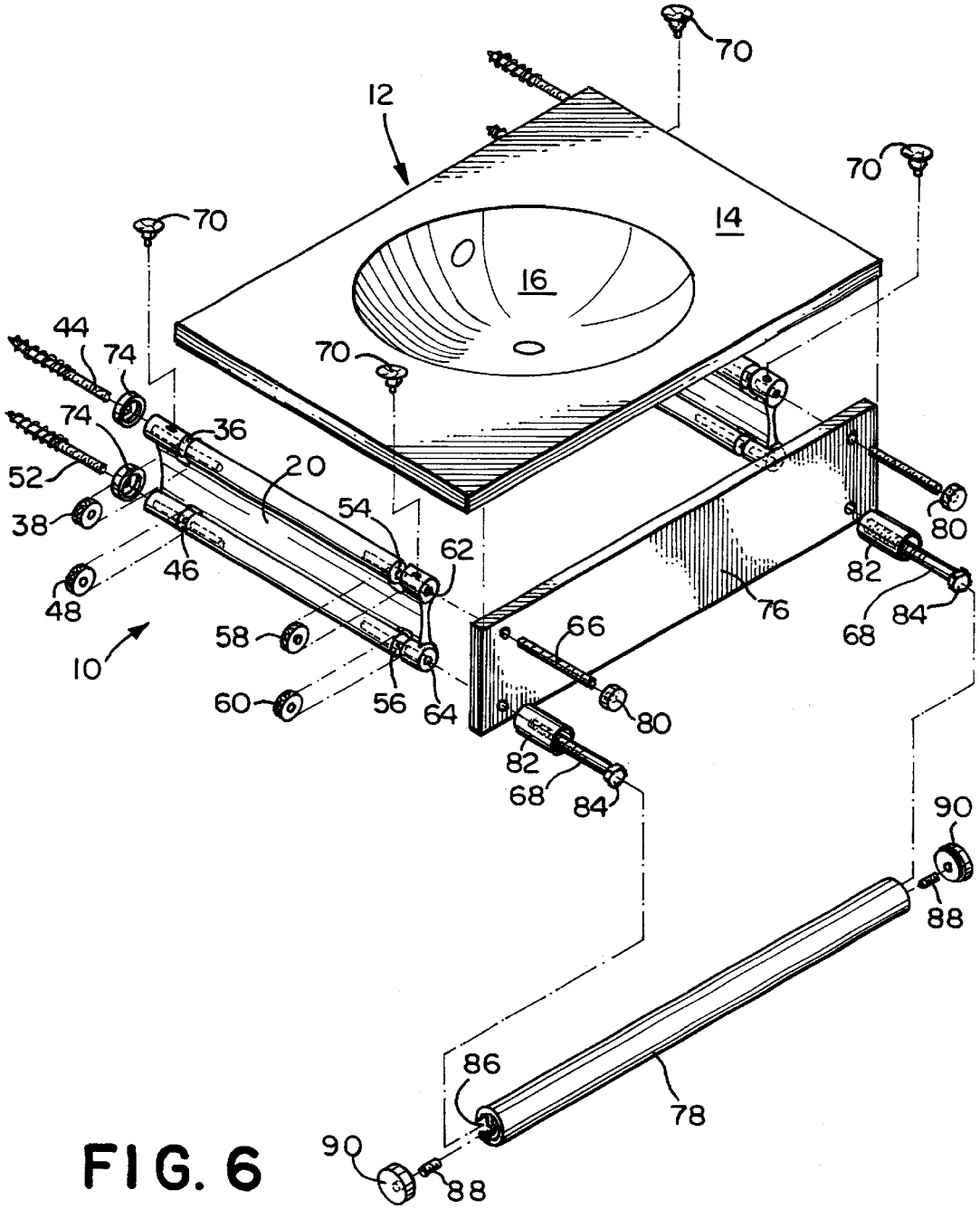
FIG. 6 is an exploded perspective view of the fixture of FIG. 1 showing the components of one of the support assemblies and the surrounding components.

As shown in FIGS. 2, 3 and 6, the support assembly 10 is comprised of an elongated generally rigid support member 20. The support member 20 includes first and second ends 22, 24, first and second lateral sides 26, 28, a top surface 30 and a bottom surface 32. In the present embodiment, the top surface 30 of the support member 20 is comprised of a generally cylindrical portion which extends from the first end 22 to the second end 24. Likewise, the bottom surface 32 of the support member 22, in the present embodiment, is comprised of a generally cylindrical portion which extends from the first end 22 to the second end 24. A web portion 34 interconnects the cylindrical portions as shown. Preferably, the support member 20 is formed of a generally rigid, high strength material, such as a metal or a polymeric material. More preferably, the support member 20 of the preferred embodiment is formed of a single piece of extruded aluminum or an aluminum alloy. It will be appreciated by those of ordinary skill in the art that the precise material or manufacturing techniques employed for making the support member 20 should not be considered to be a limitation on the present invention. In addition, the support member 20 may have a different shape and/or size from that shown in the drawings.

The support member 20 includes a first notch 36 which extends into the top surface 30 at a second predetermined distance from the first end 22. The first notch 36 is sized to receive therein a first fixing member 38. The first fixing member 38 is generally cylindrical and is approximately the same diameter as the cylindrical portion of the top surface 30 of the support member 22. The first fixing member 38 includes a threaded opening extending axially therethrough. Preferably, the first notch 36 is slightly larger in the axial directory than the first fixing member 38 so that there is sufficient clearance to permit the first fixing member 38 to freely move or rotate within the first notch 36. The depth of the first notch 36 generally corresponds with the diameter of the first fixing member 38 so the first fixing member 38 blends in with the support member 20 when installed in the first notch 36. Preferably, the exterior radial surface of the first fixing member 38 includes knurling to facilitate grasping thereof. In addition, and as best shown in FIG. 3, the first fixing member 38 includes one or more circumferentially spaced generally circular openings 40 extending into the radial exterior surface thereof to facilitate the insertion of a generally cylindrical tool or a nail (not shown) to facilitate loosening or tightening of the first fixing member 38 as will hereinafter be described in greater detail A first bore 42 extends along the top surface cylindrical portion 30 from the first end 22 toward the second end 24 of the support member 20. The first bore 42 is located at a third predetermined distance from the top surface 30 and preferably extends generally axially along the cylindrical portion so that the first bore 22 intersects with and extends beyond the first notch 36. Preferably, the first bore has a diameter which is slightly greater than the outer diameter of a first threaded rod 44, so that the first threaded rod 44 may be freely received within the first bore 42.

The support member 20 further includes a second notch 46 extending into the cylindrical portion of the bottom surface 32 at a fourth predetermined distance from the fist end 22. In the present embodiment, the fourth predetermined distance is generally equal to the second predetermined distance so that the first notch 36 and the second notch 46 are generally aligned. However, it will be appreciated by those of ordinary skill in the art that the first notch 36 and the second notch 46 may be offset from one another, if desired. The second notch 46 is sized for receiving therein a second fixing member 48. The second fixing member 48 is the same as the above-described first fixing member 38, including an axially extending threaded opening, a knurled radial outer surface and one or more small openings 40 extending into the radial outer surface. A second bore 50 extends along the cylindrical portion of the bottom surface 32 from the first end 22 toward the second end 24. The second bore 50 is located a fifth predetermined distance from the bottom surface 22 and preferably, extends along the axis of the bottom surface cylindrical portion. As shown in FIG. 3, the second bore 50 intersects with and extends beyond the second notch 46. Like the first bore 42, the second bore 50 is sized for receiving therein a second threaded rod 52.

The support assembly 10 as thus far described including the support member 20, the first and second threaded rods 44 and 52 and the first and second fixing members 38 and 48 is sufficient for supporting a fixture 12 in accordance with the present invention. However, the support assembly 10 as shown in the figures, includes additional elements and components as will hereinafter be described.

The second end 24 of the support member 22 includes a third notch 54 extending into the top surface 30 and a fourth notch 56 extending into the bottom surface 32. The third and fourth notches 54, 56 are substantially the same as the first and second notches 36, 46 as described above and are sized for receiving third and fourth fixing members 58, 60 which are also the same as the first fixing member 38 as described above. Third and fourth bores 62, 64 extend axially along the top surface cylindrical portion 30 and bottom surface cylindrical portion 32 from the second end 24 toward the first end 22 in the same manner as described above in connection with the first and second bores 42, 50. The third and fourth bores 62, 64 intersect and extend beyond the third and fourth notches 54, 56 respectively and are sized for receiving third and fourth threaded rods 66, 68 in the manner as described above. The third and fourth threaded rods 66, 68 include threading which is sized for threaded engagement with the threading of the third and fourth fixing members 58, 60.

As best shown in FIG. 3, the overall length of the support member 20 is substantially the same as, but preferably, slightly less than the overall depth of the fixture 12 which is to be supported. Preferably, the thickness of the support member 20, as well as the overall height of the support member 20 are sufficient to provide the necessary structural support for the fixture 12. In a preferred embodiment, the support member 20 has an overall length of approximately 21" and overall thickness of approximately 1¼" and a height of approximately 6½". It will be appreciated by those of ordinary skill in the art that the foregoing dimensions are provided only for the purpose of illustration and should not be considered to be a limitation on the present invention.

While in some applications, the undersurface of the fixture 12 may be supported directly on the support member 20, in the present embodiment, and as best illustrated in FIGS. 3 and 6, a pair of engaging members 70 are secured to the top surface 30 of the support member 20 proximate to the first and second ends 22, 24. The engaging members 70 are provided for the purpose of engaging the undersurface of the fixture 12 to provide cushioned support as well as to grip and partially hold the fixture 12 in position. In the present embodiment, the engaging members 70 comprise suction cups. However, it will be appreciated by those of ordinary skill in the art that other types of engaging members 70 may be employed. For example, generally cylindrical rubber-bumpers or similar engagement members may alternatively be employed.

Set forth below is a preferred method of using the support assembly 10 for the purpose of supporting a fixture, such as the bathroom sink 12 as illustrated. Again, only a single support assembly 10 will be described with the understanding that the fixture 12 is actually supported by two support assemblies 10, one on each lateral side. As best shown in FIG. 3, the first and second threaded rods 44 and 52 have a first end which includes spiral threading of the type used in wood screws. Using a template for proper spacing, a pair of holes are drilled into the wall 18 and the first ends of the first and second threaded rods 44, 52 are screwed into the holes in the wall such that the threading is in firm engagement with a wooden stud 72 or other such strong support member. When installed in this manner, the threaded rods 44, 52 extend out from the wall a first predetermined distance. The first end 22 of the support member 20 is then installed with the first and second threaded rods 44, 52 extending into the first and second bores 42, 50 as shown in FIG. 3. Before installing the support member 20, a pair of cup-like end caps 74 may be installed on the threaded rods 44, 52. Preferably, the end caps 74 are formed of a polymeric material and are provided to cover the holes in the wall 18 around the threaded rods 44, 52. As the threaded rods 44, 52 extend through the first and second bores 42, 50, the first and second fixing members 38, 48 are rotated within the first and second notches 36, 46 to threadingly engage the threaded rods 44, 52. Thereafter, the first and second fixing members 38, 48 are rotated in a clockwise or tightening direction to cause the first end 22 of the support member 20 to tightly engage the end caps 74, and, thus, the wall 18 as shown in FIGS. 2 and 3. The knurled outer surface of the first and second fixing members 38, 48 facilitates rotation of the fixing members. In addition, the small openings 40 in the outer surface of the fixing members 38, 48 are adapted for receiving a small tool or a nail (not shown) to permit the fixing members 38, 48 to be fully tightened.

It is important that the support member 20 be perfectly level to provide proper level support for the fixture 12. If the supporting wall 18 is perfectly vertical, once the fixing members 38, 48 are completely tightened, the support member 20 will be perfectly horizontal. However, since it is well known that most walls are not perfectly vertical, the position of the support member 20 must usually be adjusted to make it horizontal. Such adjustment is accomplished by placing a small level 76 on the support member 20 as shown in FIG. 2 and thereafter rotating one of the fixing members 38, 48, preferably the second fixing member 48, in the counter-clockwise direction to move the bottom of the first end of the support member 20 away from the wall 18 until the support member 20 is perfectly horizontal.

The support assembly 10 is also employed to support a decorative front panel 76 and a towel bar 78 as best shown in FIG. 1. Installation of the decorative panel 76 and towel bar 78 will hereinafter be described. It should be appreciated by those of ordinary skill in the art that the decorative front panel 76 and towel bar 78 are preferably installed after the support members 20 are installed on the wall 18. However, if desired, the decorative front panel 76 and towel bar 78 could be installed on the support members 20 prior to installation on the wall 18.

As best shown in FIG. 3, the decorative front panel 76 is secured to the support member 20 utilizing the third and fourth threaded rods 66, 68 which extend through the third and fourth bores 62 and into threaded engagement with the third and fourth fixing members 58, 60. The outwardly extending end of the third threaded rod 66 extends through an opening in the decorative front panel 76 and is covered by a decorative cap 80. A portion of the fourth threaded rod 68 also extends through an opening in the decorative front panel 76 and is covered by a decorative, cylindrical spacer member 82. The distal end of the fourth threaded rod 68 includes a head 84 which is slidingly received within a slot 86 which extends along the rear surface of the towel bar 78. A small set screw 89 extends into the end of the towel bar slot 86 to effectively lock the towel bar 78 in place and a decorative cap 90 covers the distal end of the towel bar 78 to provide a pleasing appearance. The position and angular orientation of the decorative front panel 76 and the towel bar 78 may be adjusted by rotating the third and fourth fixing members 58, 60 if desired. Once the installation of the decorative front panel 76 and towel bar 78 has been completed the bathroom sink 12 may be installed. As best shown in FIG. 3, the suction cups 76 engage and provide cushioned support to the undersurface of the fixture 12.

From the foregoing description, it can be seen that the present invention comprises a support assembly for supporting a fixture on a wall. It will be appreciated by those of ordinary skill in the art that changes could be made to the embodiment described above without departing from the broad inventive concepts thereof. It is understood, therefore, that this invention is not limited to the particular embodiment disclosed, but is intended to cover all modifications within the scope and spirit of the invention as defined by the appended claims.

What is claimed is:

1. A support assembly for supporting a fixture on a wall, the support assembly comprising:

first and second threaded rods for installation into the wall so that at least a portion of each rod extends outwardly from the wall by at least a first predetermined distance;

first and second fixing members each having internal threads which compliment the threads on the threaded rods; and an elongated generally rigid support member, having first and second ends, first and second lateral sides and top and bottom surfaces, the support member including;

a first notch in the top surface at a second predetermined distance from the first end, the first notch being sized for receiving the first fixing member therein, a first bore extending from the first end toward the second end, the first bore being located a third predetermined distance from the top surface and intersecting the first notch, the first bore being sized for receiving the first threaded rod, a second notch in the bottom surface at a fourth predetermined distance from the first end, the second notch being sized for receiving the second fixing member therein, and a second bore extending from the first end toward the second end, the second bore being located a fifth predetermined distance from the bottom surface and intersecting the second notch, the second bore being sized for receiving the second threaded rod, whereby in use, the support member is installed with the first end in engagement with the wall and with the first and second threaded rods extending into the first and second bores respectively, the first threaded rod being in threaded engagement with the first fixing member in the first notch and the second threaded rod being in threaded engagement with the second fixing member in the second notch, the first and second fixing members being rotatable within the first and second notches respectively to secure the support member to the wall and adjust the support member to be level.

2. The support assembly as recited in claim 1, wherein the top surface comprises a generally cylindrical portion which extends from the first end to the second end, the bottom surface includes a generally cylindrical portion which extends from the first end to the second end and a web portion interconnects the first and second cylindrical portions.

3. The support assembly as recited in claim 2, wherein the first and second fixing members are generally cylindrical with an axially length generally corresponding to the length of the first and second notches.

4. The support assembly as recited in claim 3, wherein the circumferential outer surface of the first and second fixing members includes knurling.

5. The support assembly as recited in claim 4, wherein the circumferential outer surface of the first and second fixing members includes at least one generally cylindrical opening extending therein.

6. The support assembly as recited in claim 5, further including an engaging member on the top surface proximate to each of the first and second ends.

7. The support assembly as recited in claim 6, wherein the engaging members comprise suction cups.

8. The support assembly as recited in claim 1, further including:

a third threaded rod for supporting a panel;

a third fixing member having internal threads which compliment the threads on the third threaded rod;

a third notch in the top surface at a predetermined distance from the second end, the third notch being sized for receiving the third fixing member therein; and a third bore extending from the second end toward the first end, the third bore being located a predetermined distance from the top surface and intersecting the third notch, the third bore being sized for receiving the third threaded rod whereby in use, the third threaded rod is secured to a panel with a portion of the third threaded rod extending into the third bore and in threaded engagement with the third fixing member in the third notch, the third fixing member being rotatable within the third notch to secure the panel to the second end of the support member.

9. The support assembly as recited in claim 8, further including:

a fourth threaded rod for supporting a towel bar;

a fourth fixing member having internal threads which compliment the threads on the fourth threaded rod;

a fourth notch in the bottom surface of the support member at a predetermined distance from the second end, the fourth notch being sized for receiving the fourth fixing member therein; and a fourth bore extending from the second end toward the first end, the fourth bore being located a predetermined distance from the bottom surface and intersecting the fourth notch, the fourth bore being sized for receiving the threaded rod whereby in use, the fourth threaded rod with the towel bar on one end extends into the fourth bore and in threaded engagement with the fourth fixing member in the fourth notch, the fourth fixing member being rotatable within the fourth notch for securing the towel bar to the support member.

* * * * *